US009119473B2

(12) United States Patent
Kordyl

(10) Patent No.: US 9,119,473 B2
(45) Date of Patent: Sep. 1, 2015

(54) SEAT WITH ADJUSTABLE BACK PROFILE

(75) Inventor: Grzegorz Kordyl, Lodz (PL)

(73) Assignee: LIW CARE TECHNOLOGY SP.Z.O.O., Lodz (PL)

( * ) Notice: Subject to any disclaimer, the term of this patent is extended or adjusted under 35 U.S.C. 154(b) by 74 days.

(21) Appl. No.: 14/115,351

(22) PCT Filed: May 5, 2011

(86) PCT No.: PCT/EP2011/057209

§ 371 (c)(1),
(2), (4) Date: Jan. 27, 2014

(87) PCT Pub. No.: WO2012/149978

PCT Pub. Date: Nov. 8, 2012

(65) Prior Publication Data

US 2014/0167464 A1 Jun. 19, 2014

(51) Int. Cl.

| | |
|---|---|
| ***A47C 7/14*** | (2006.01) |
| ***A47C 7/46*** | (2006.01) |
| ***A47C 7/40*** | (2006.01) |
| ***A47C 31/12*** | (2006.01) |
| ***A61G 5/12*** | (2006.01) |
| *A61G 5/10* | (2006.01) |

(52) U.S. Cl.

CPC ..... *A47C 7/462* (2013.01); *A47C 7/405* (2013.01); *A47C 31/126* (2013.01); *A61G 5/12* (2013.01); *A61G 2005/1091* (2013.01); *A61G 2005/122* (2013.01)

(58) Field of Classification Search

USPC ..... 297/284.3, 284.4, 452.28, 452.18

See application file for complete search history.

(56) References Cited

U.S. PATENT DOCUMENTS

| | | | | |
|---|---|---|---|---|
| 3,877,750 | A * | 4/1975 | Scholpp | 297/284.3 |
| 5,328,245 | A * | 7/1994 | Marks et al. | 297/284.3 |
| 6,589,143 | B2 * | 7/2003 | Taylor | 482/134 |
| 6,609,754 | B2 * | 8/2003 | Rajasingham | 297/284.3 |
| D527,557 | S * | 9/2006 | Reimers | D6/716.4 |
| 7,648,201 | B2 * | 1/2010 | Eysing | 297/284.3 |
| 7,784,871 | B2 * | 8/2010 | Cochran | 297/338 |
| 7,802,846 | B2 * | 9/2010 | Bellefleur | 297/284.3 |

(Continued)

FOREIGN PATENT DOCUMENTS

| | | | |
|---|---|---|---|
| DE | 3100770 | A1 | 8/1982 |
| EP | 2039271 | A1 | 3/2009 |
| WO | 2011006502 | A1 | 1/2011 |

*Primary Examiner* — David R Dunn
*Assistant Examiner* — Alexander Harrison
(74) *Attorney, Agent, or Firm* — Mark M. Friedman

(57) ABSTRACT

A seat comprising a back support portion (100) with adjustable surface profile, comprising an adjustable core column (101) arranged along the height direction of the back support portion (100) and comprising a plurality of holders (110, 210, 211, 310, 410) and a plurality of side members (120, 220, 221, 320, 420) fixed to the holders (110, 210, 211, 310, 410) and extending substantially in the width direction of the back support portion (100) such as to profile the surface of the back support portion (100). It further comprises profile locking means (130) coupled with a plurality of holders (110, 210, 211, 310, 410) and adjustable to an unlocked configuration, in which the holders (110, 210, 211, 310, 410) are individually rotatable around a plurality of axes and the profile of the surface of the back support portion (100) is adjustable and to a locked configuration, in which the holders (110, 210, 211, 310, 410) are fixed still with respect to each other and the profile of the surface of the back support portion (100) is locked.

5 Claims, 7 Drawing Sheets

(56) References Cited

U.S. PATENT DOCUMENTS

| | | | | |
|---|---|---|---|---|
| 8,528,980 | B1 * | 9/2013 | Hsiao | 297/452.18 |
| 8,939,507 | B2 * | 1/2015 | Thomaschewski et al. | 297/284.3 |
| 2004/0256899 | A1 * | 12/2004 | Moore et al. | 297/284.3 |
| 2006/0152051 | A1 * | 7/2006 | Colja et al. | 297/284.4 |
| 2006/0255635 | A1 * | 11/2006 | Iijima et al. | 297/284.3 |
| 2009/0236887 | A1 * | 9/2009 | Lu et al. | 297/284.3 |
| 2013/0127219 | A1 * | 5/2013 | Gerwig | 297/284.3 |
| 2014/0159450 | A1 * | 6/2014 | Guering | 297/284.3 |

* cited by examiner

SEAT WITH ADJUSTABLE BACK PROFILE

TECHNICAL FIELD

The present invention relates to seats having back support portion with an adjustable surface profile.

BACKGROUND ART

The profile of the back support portion of a seat impacts not only the comfort of seating, but physiological functions of the organism as well. Standard seats with non-adjustable back profiles which do not appropriately match the spinal profile of the seat occupant may result in spine aches or even spine deformations. Moreover, such seats do not allow correction of spine deformations. Seats with adjustable back profile are known, which can be used to increase the comfort of seating or even help in correcting spine deformations of the occupant.

A U.S. Pat. No. 4,944,554 presents an active biomechanical chair with a back rest comprising a plurality of contour adjusting mechanisms having plate means which are horizontally adjustable to fit with a spinal profile of a person using the chair. Each contour adjusting mechanism is adjustable independently by individual motor means controlled with a central controller, which makes the construction relatively complex and costly.

A U.S. Pat. No. 5,328,245 presents a chair having an adjustable back support, comprising a support bar and a plurality of segments received on said support bar wherein each segment defines a slot for receiving the support bar, said slot being elongated to allow the segment to slide in a forward direction, as well as a locking mechanism actuable from a first position in which said segments are movable in a forward direction to a second position in which said segments are held stationary. The profile of the back support is relatively complicated to adjust due to a large number of segments. Moreover, the segments allow profile adjustment only in one plane.

A US patent application US20040195882 presents a seat comprising seat elements arranged to move rotatably with respect to a central axis running centrally through the seat back parallel to the spine of the occupant in a normally seated position. The seat profile accommodates automatically to the profile of the back of the occupant, which may increase seating comfort, but also intensifies possible pathologies in the shape of the back of the occupant.

DISCLOSURE OF THE INVENTION

The aim of the present invention is to provide a seat with an adjustable back profile which has a simple construction and can be easily profiled in more than one plane. Such functionality can be useful for adjusting the seat to the needs of occupants with pathological spinal profile in order to induce correct seating position and to correct the back profile.

The object of the present invention is a seat comprising a back support portion with adjustable surface profile, comprising an adjustable core column arranged along the height direction of the back support portion and comprising a plurality of holders and a plurality of side members fixed to the holders and extending substantially in the width direction of the back support portion such as to profile the surface of the back support portion, wherein the seat further comprises profile locking means coupled with a plurality of holders and adjustable to an unlocked configuration, in which the holders are individually rotatable around a plurality of axes and the profile of the surface of the back support portion is adjustable and to a locked configuration, in which the holders are fixed still with respect to each other and the profile of the surface of the back support portion is locked.

The seat may further comprise a plurality of profile locking means, each coupled with a different group of a plurality of holders.

The profile locking means may comprise an elastic element extending through the plurality of holders and having ends fixed to locking elements located next to terminal holders of the plurality of holders, wherein at least one locking element allows shortening of the elastic element between the locking elements, such as to tighten the coupling between the holders.

The locking elements can be fixed to a frame of the back support portion.

The frame of the back support portion may have adjustable height and/or is pivotable about its bottom portion.

The holders can may comprise a bottom spherical recess configured to receive a top spherical portion of a neighboring holder.

The seat may further comprise spacers having a coarse surface in a form of a segment of a sphere placed between neighboring holders.

The spacers may have a central through-hole of a diameter smaller than the diameter of a central through-hole of the holders.

The holders may have a central opening in form of a truncated cone.

The seat may further comprise holders of a tubular shape and spacers of a spherical shape having a diameter larger than the internal diameter of the holders and placed partially inside neighboring holders.

The holders may have coarse edges.

The spacers may have a central through-hole of a diameter smaller than the internal diameter of the holders.

The seat may further comprise spacers in form of a cylinder with a horizontal axis placed between neighboring holders.

The seat may further comprise plates attached to the side members for increasing the area of the profiled surface of the back support portion.

BRIEF DESCRIPTION OF DRAWINGS

The invention is shown by means of exemplary embodiments on a drawing, in which.

MODES FOR CARRYING OUT THE INVENTION

Figure 1:
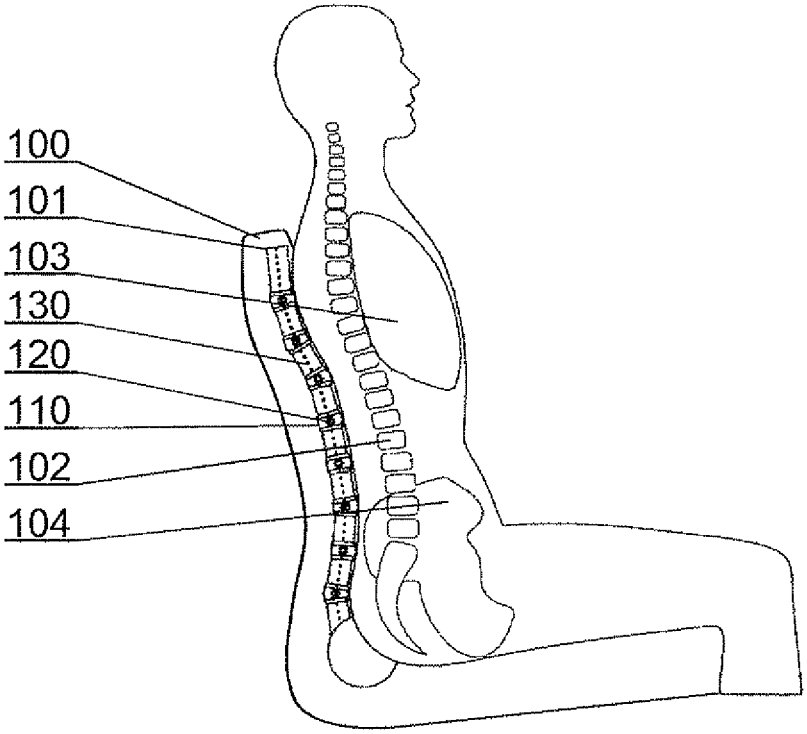
FIG. 1 shows a side schematic view of a seat with a back support portion having adjustable surface profile.

FIG. 1 shows a side schematic view of a seat with a back support portion 100 having adjustable surface profile. The surface is profiled by an adjustable core column 101 arranged along the height direction of the back support portion 100 and side members 120 extending therefrom in the width direction of the back support portion 100. An elastic material, such as a foam, may cover the core column and the side members 120 to increase the seating comfort. The profile of the back support portion should be appropriately matched with the profile of the spine 102 of the seat occupant. Appropriate matching results in a correct seating position, in which the spine 102 of the occupant is inclined to a correct position and the internal organs may function correctly, for example the lungs 103 can expand freely and the stomach 104 is not contracted. For some occupants with pathological spinal profile it may be helpful to profile the back support portion not only along the vertical direction, but along horizontal direction as well. The core column 101 comprises profile locking means 130 adjustable to an unlocked and locked configuration.

Figure 2:
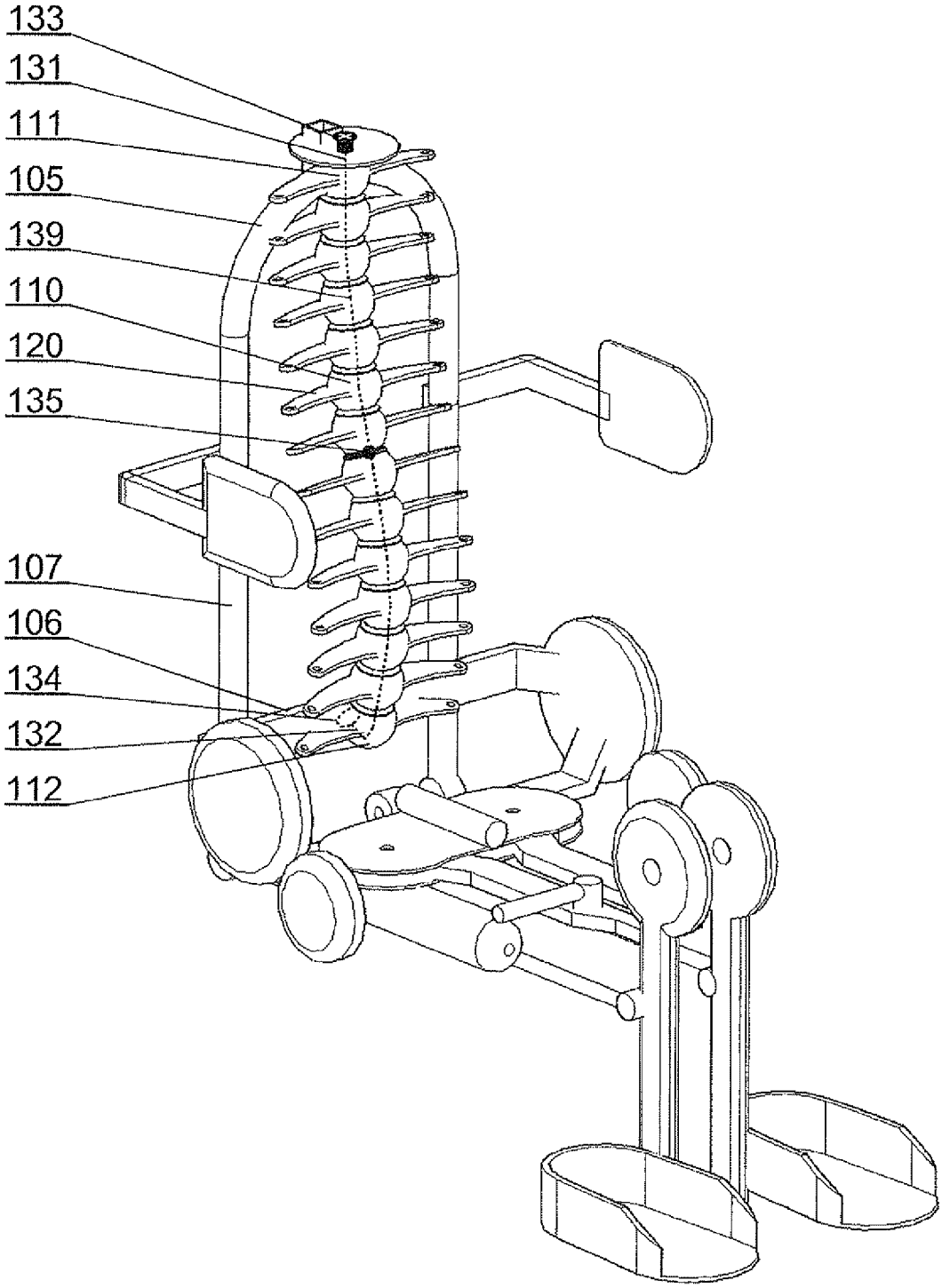
FIG. 2 shows a configuration of the seat with the back support portion according to a first embodiment of the present invention.

FIG. 2 shows a configuration of the seat with the back support portion according to a first embodiment of the present invention. The adjustable core column 101 comprises a plurality of holders 110 and a plurality of side members 120 fixed to the holders 110. The side members 120 extend substantially in the width direction of the back support portion such as to profile its surface. Profile locking means 130, which in the present embodiment comprise an elastic element 139, preferably inextensible, such as a steel cord, a plastic cord or a chain, are coupled with a plurality of holders 110 and adjustable to an unlocked configuration, in which the holders 110 are individually rotatable around a plurality of axes such that the profile of the surface of the back support portion is adjustable and to a locked configuration, in which the holders 110 are fixed still with respect to each other and the profile of the surface of the back support portion is locked.

The profile locking means 130 in the present embodiment comprise a cord 139, preferably a steel cord, coupled with the holders 110 by extending through central through-holes of neighboring holders 110. The ends 131, 132 of the cord are fixed to locking elements 133, 134 located next to the terminal holders 111, 112 of the plurality of holders 110 with which the cord 139 is coupled. At least one locking element 133, such as an adjustable screw around which the cord 139 is wound, allows shortening of the cord 139 between the locking elements 133, 134, thereby tightening the coupling between the holders 110. The adjustable locking element 133 may be fixed to a top portion 105 of the frame of the back support portion. In order to compensate for a change in height and inclination of the back support portion as a result of profiling, the frame of the back support portion may have vertical members 107 of adjustable height, joining the top portion 105 with a bottom portion 106 and mounted pivotably on the bottom portion 106. The other locking element 134 may hold still the cord 139, for example fix the cord to the bottom portion 106 of the frame of the back support portion. With sufficient tightening force, defining the locking configuration, the holders 110 are fixed still with respect to each other and the profile of the surface of the back support portion is locked. The cord 139 may extend through all holders 110 such as to allow unlocking and locking of the whole back support profile. Alternatively, a plurality of cords may be used, each extending through a different set of a plurality of holders 110, such as to allow unlocking and locking the back support profile partially, which may allow more precise profiling. For example, one cord may extend from a locking element 135 located in the middle of the core column towards the upper terminal holder 111 and another cord may extend from the middle locking element 135 towards the lower terminal holder 112, wherein the middle locking element 135 holds one end of both cords and the other ends of the cords are fixed to locking elements 133, 134, in that case the locking element 134 should allow shortening of the cord.

Figure 3A:
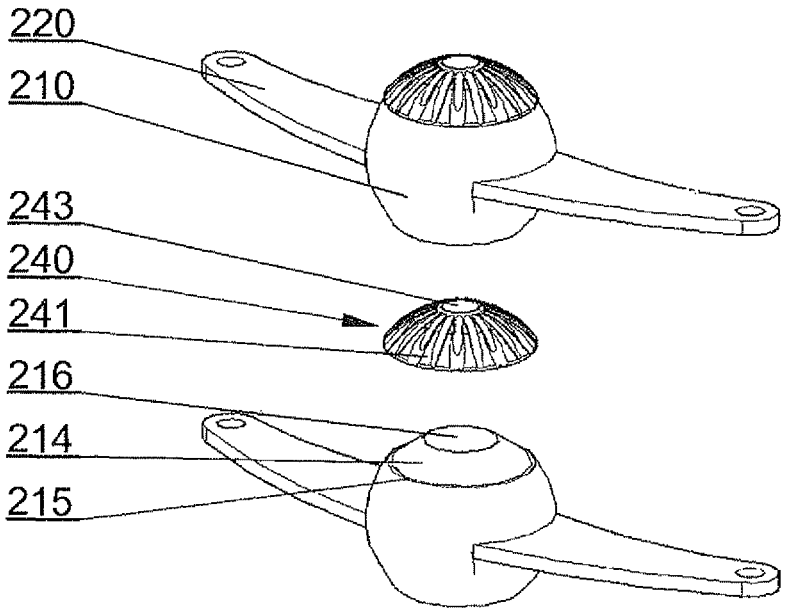
FIGS. 3A and 3B show exploded views from the top and from the bottom, respectively, of the structural elements of the core column according to the first embodiment.
Figure 3B:
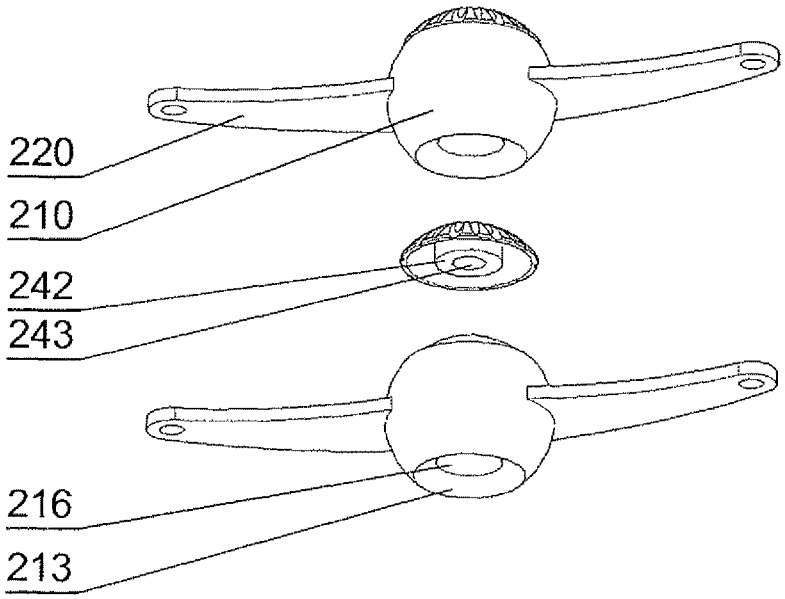

FIGS. 3A and 3B show exploded views from the top and from the bottom, respectively, of the structural elements of the core column according to the first embodiment. The core column comprises holders 210 of spherical shape, to which side members 220 are fixed. The holders 210 have a bottom recess 213 configured to receive a top portion 214 of a neighboring holder. A spacer 240, preferably in a form of a cap shaped as a segment of a sphere, may be placed between neighboring holders 210. The top portion 214 of the holder 210 may have a relief 215 for accommodating the spacer 240. The spacer 240 has a coarse top surface 241, which increases the friction between the spacer 240 and the bottom recess 213 of the holder 210 in the locked configuration of the core column, thereby fixing still the position of the holders 210 with respect to each other. In the unlocked configuration, the spacer 240 may rotate within the bottom recess 213. The spacer 240 is fixed with respect to the top portion 214 of the holder via the relief 215 and via a wall 242 which surrounds a central through-hole 243 of the spacer 240 and extends from the inner surface of the spacer 240 downwards, wherein the external diameter of the wall 242 is substantially equal to the diameter of the central through-hole 216 of the holder 210. The diameter of the spacer through-hole 243 can be substantially equal to the diameter of the cord 139, which allows keeping the cord 139 in the centre of the top portion of the holder 210. In turn, the diameter of the holder through-hole 216 can be significantly larger from the diameter of the cord 139, which allows inclination of the cord 139 with respect to the holder through-hole 216 in order to allow rotation of holders around a plurality of axes in the unlocked configuration, thereby allowing profiling of the back support portion along its width as well as height direction.

Figure 3C:
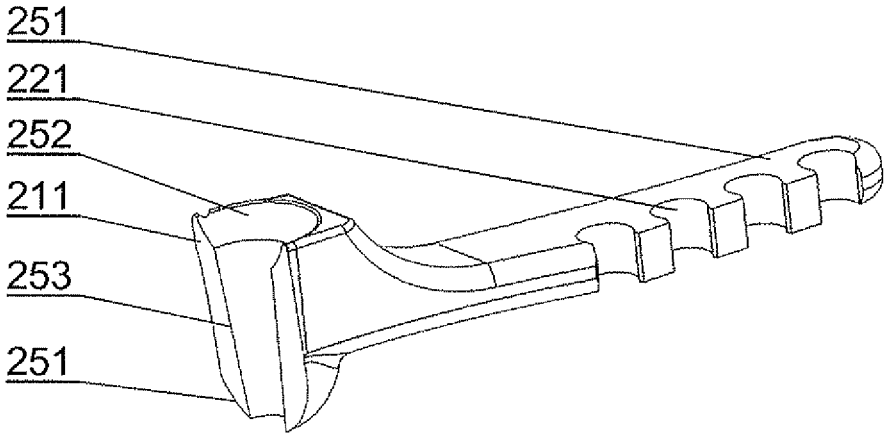
FIG. 3C shows a cut through an embodiment of a holder for use in the seat according to the first embodiment.

FIG. 3C show a cut view of an embodiment of a holder 211 for use in the seat according to the first embodiment, instead or together with the holders 210. The holder 211 has a spherical bottom portion 251 and a top recess 252 configured for receiving the bottom portion 251 of a neighboring holder. The central hole 253 of the holder has a shape of a truncated cone, i.e. the upper diameter D of the opening 253 is larger than the lower diameter d. Optionally, the upper diameter can be smaller than the lower diameter. Such difference in diameters allows to keep the cord near the centre of the opening 253 in one part of the holder 211 and next to the edge of the opening 253 in another part of the holder 211, which enables rotation of the holders around a plurality of axes in the unlocked configuration. The bottom portion 251 and/or the top recess 252 may have a coarse surface, in order to allow engagement of neighboring holders 211 in the locked configuration. The side elements 221 have a set of openings 222 for mounting plates to increase the area of the profiled back surface, similar to the plates shown in FIG. 5. The openings 222 are situated in different distances from the centre of the holder 211, which allows mounting the plates at different places.

Figure 4:
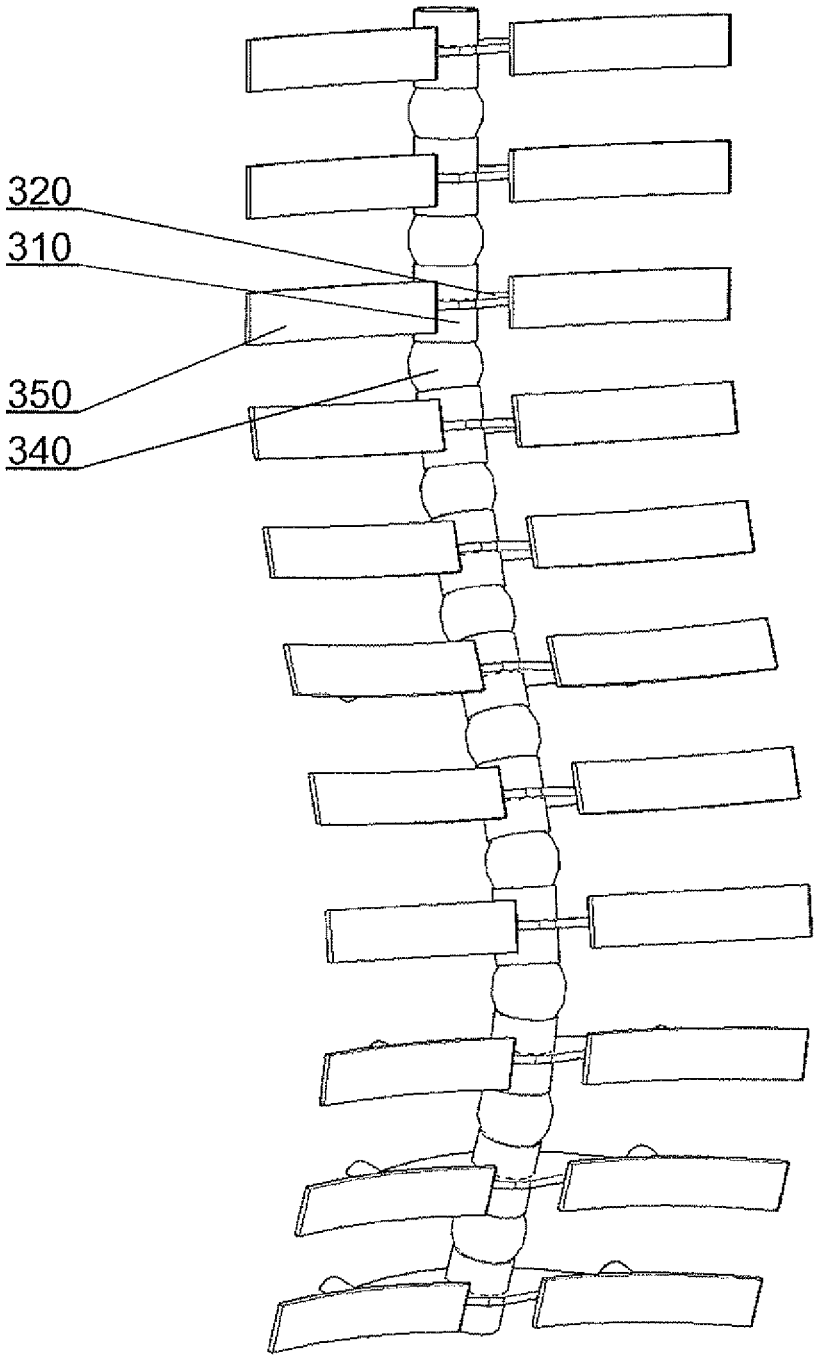
FIG. 4 shows a configuration of the core column according to a second embodiment of the present invention.
Figure 5:
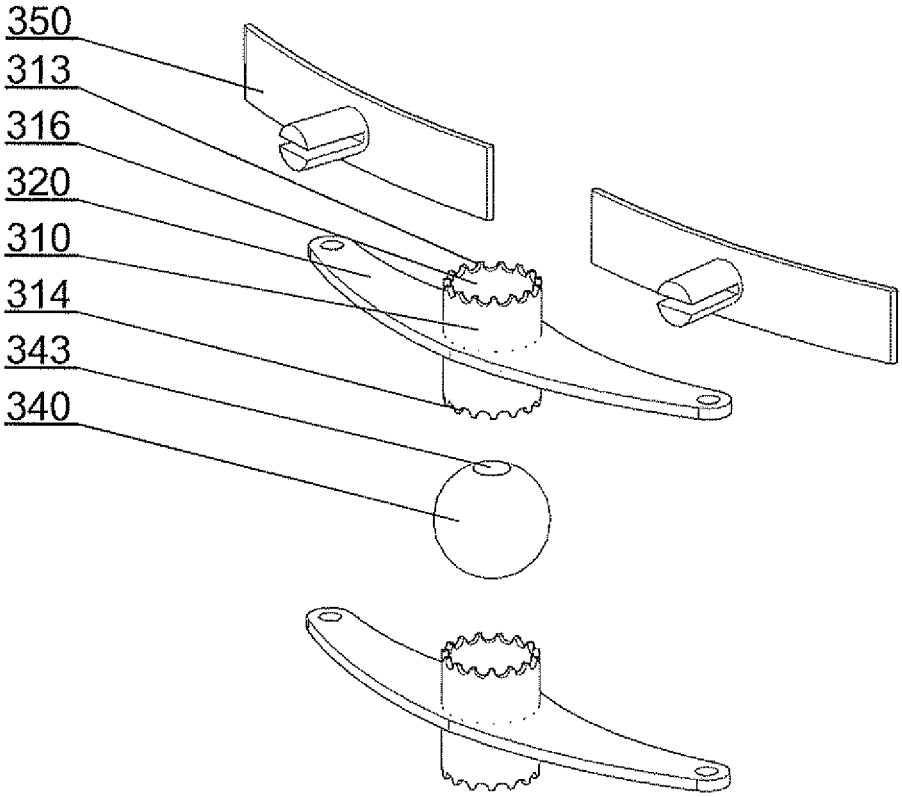
FIG. 5 shows exploded view of the structural elements of the core column according to the second embodiment.

FIG. 4 shows a configuration of the core column according to a second embodiment of the present invention, and FIG. 5 shows exploded view of its structural elements. The core column comprises holders 310 of tubular shape, to which side members 320 are fixed. A spacer 340, preferably in a form of a sphere, is placed between neighboring holders 310 and partially fits inside the tubular holders 310. The holders 310 have a coarse, preferably serrated, top and bottom edges 313, 314 configured to receive partially the spherical spacers 340 having a diameter larger than the internal diameter 316 of the tubular holders 310. The coarse edges 313, 314 of the holders 310 increase the friction between the spacers 340 and the holders 310 in the locked configuration of the core column, thereby fixing still the position of the holders 310 with respect to each other. The spacers 340 have a central through-hole 343 which is preferably narrower than the internal diameter of the holders 310 and preferably substantially equal to the diameter of the cord 139, to position the cord 139 within the holders 310 away from the side edges of the holders 310. In the unlocked configuration, the tubular holders 310 can rotate around the spherical spacers 340 around a plurality of axes, thereby allowing profiling of the surface of the back support portion along its width, as well as height direction. Additional plates 350 can be attached, elastically or rigidly, to the side members 320 for increasing the area of the profiled surface of the back support portion.

Figure 6:
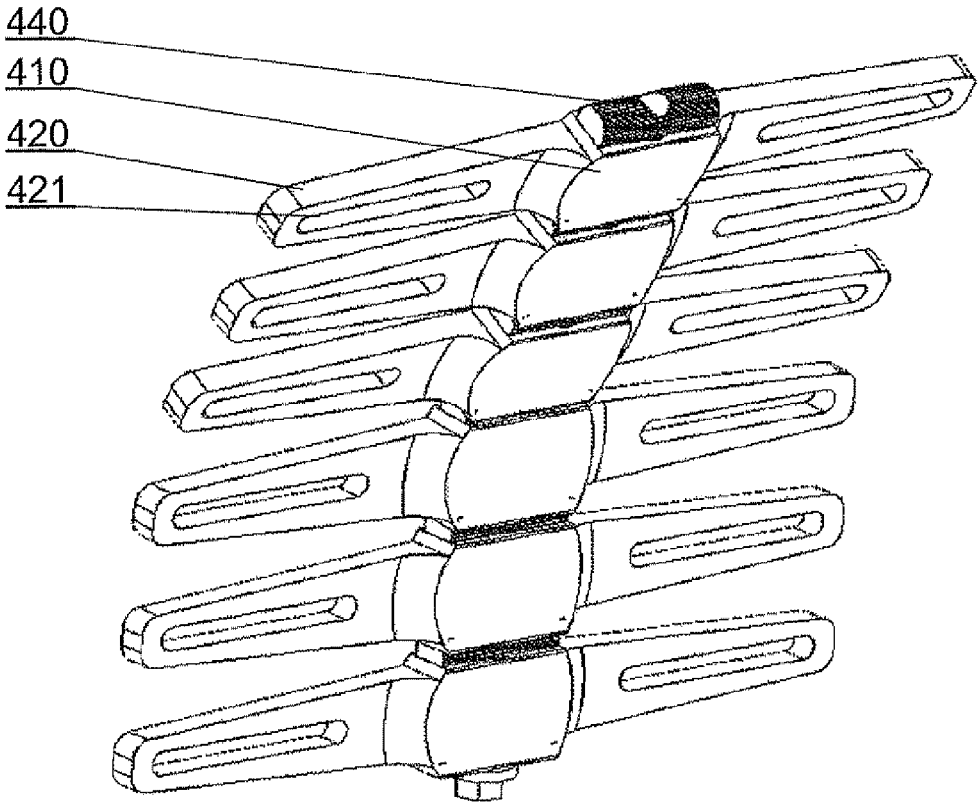
FIG. 6 shows a configuration of the core column according to a third embodiment of the present invention.
Figure 7A:
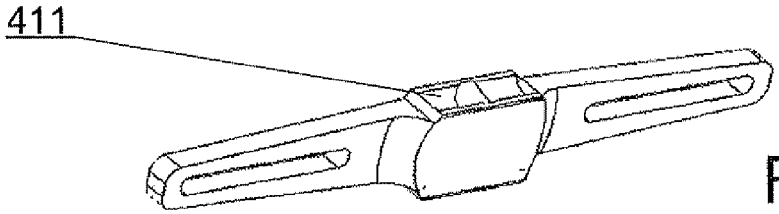
FIGS. 7A and 7B show perspective views from the top and from the bottom of the holders used in the third embodiment.
Figure 7B:
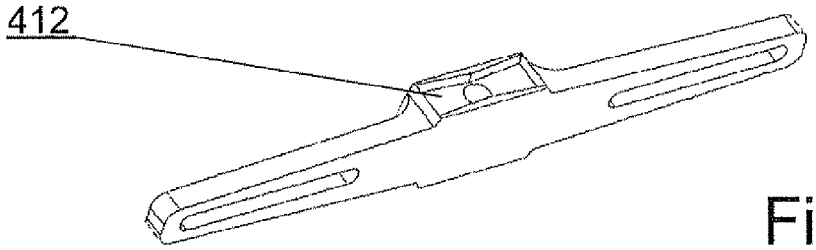

FIG. 6 presents a configuration of the core column according to a third embodiment of the invention, and FIGS. 7A and 7B present top and bottom views of the holders used in this embodiment. The core column comprises holders 410 with integrated side elements 420. A spacer 440 having a form of a cylinder with coarse surface is placed between the holders 410 and fits partially into the holders 410. The holders 410 have in their top portion a cylindrical recess 411, in which the spacer 440 can rotate around a horizontal axis, and in their bottom portion a triangular recess 412, in which the spacer 440 can rotate around a vertical axis. Therefore, in the unlocked configuration, the neighboring holders 410 can be rotated with respect to each other both around a horizontal and a vertical axis. The side elements 420 may have longitudinal openings 421 for mounting therein a plate for increasing the profiled back surface, in a range of widths corresponding t the width of the longitudinal opening 421.

Various further modifications can be made to the embodiments mentioned above. For example, the core column may comprise a mix of holders and spacers of both embodiments. For example, one portion of the core column may comprise holders according to the first embodiment, while another portion may comprise holders according to the second embodiment. Alternative profile locking means can be used, such as e.g. magnetic coupling between the holders, wherein the locked and unlocked configuration is controllable by the magnitude of magnetic force between the holders.

The invention claimed is:

1. A seat comprising:

a back support portion with adjustable surface profile;

an adjustable core column arranged along the height direction of the back support portion, the adjustable core column comprising a plurality of holders and a plurality of side members fixed to the holders and extending substantially in the width direction of the back support portion such as to profile the surface of the back support portion; and profile locking means coupled with a plurality of holders and adjustable to an unlocked configuration, in which the profile of the surface of the back support portion is adjustable, and to a locked configuration, in which the holders are fixed still with respect to each other and the profile of the surface of the back support portion is locked, wherein the holders are coupled with neighbouring holders via spacers through a spherical joint configured such that in the unlocked configuration of the profile locking means the holders are individually rotatable around a plurality of axes with respect to the neighbouring holders, wherein the holders have a spherical recess configured to receive a spherical portion of the neighbouring holder, the seat further comprising spacers with a coarse surface in a form of a segment of a sphere placed between the neighboring holders, wherein the spacers have a central through-hole of a diameter smaller than a diameter of a central through-hole of the holders.

2. The seat according to claim 1, wherein the profile locking means comprise an elastic element extending through the plurality of holders and having ends fixed to locking elements located next to terminal holders of the plurality of holders, wherein at least one locking element allows shortening of the elastic element between the locking elements, such as to tighten the coupling between the holders.

3. The seat according to claim 1, wherein the locking elements are fixed to a frame of the back support portion.

4. The seat according to claim 3, wherein the frame of the back support portion has adjustable height and/or is pivotable about its bottom portion.

5. A seat comprising:

a back support portion with adjustable surface profile;

an adjustable core column arranged along the height direction of the back support portion, the adjustable core column comprising a plurality of holders and a plurality of side members fixed to the holders and extending substantially in the width direction of the back support portion such as to profile the surface of the back support portion; and profile locking means coupled with a plurality of holders and adjustable to an unlocked configuration, in which the profile of the surface of the back support portion is adjustable and to a locked configuration, in which the holders are fixed still with respect to each other and the profile of the surface of the back support portion is locked, wherein the holders are coupled with neighbouring holders directly through a spherical joint configured such that in the unlocked configuration of the profile locking means the holders are individually rotatable around a plurality of axes with respect to the neighbouring holders, wherein the holders have a central opening in a shape of a truncated cone.

* * * * *